US007354124B2

(12) United States Patent
Oshima et al.

(10) Patent No.: US 7,354,124 B2
(45) Date of Patent: Apr. 8, 2008

(54) PRINTING DEVICE, PRINTING METHOD, AND PROGRAM PRODUCT THEREFOR

(75) Inventors: Yasuhiro Oshima, Nagano-ken (JP); Goro Ishida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 359 days.

(21) Appl. No.: 10/964,823

(22) Filed: Oct. 15, 2004

(65) Prior Publication Data

US 2005/0225589 A1 Oct. 13, 2005

(30) Foreign Application Priority Data

Oct. 16, 2003 (JP) ..... 2003-356389

(51) Int. Cl.
*B41J 29/38* (2006.01)
*B41B 27/02* (2006.01)

(52) U.S. Cl. ..... 347/5; 358/1.15

(58) Field of Classification Search ..... 347/5, 347/9

See application file for complete search history.

(56) References Cited

U.S. PATENT DOCUMENTS 5,396,616 A * 3/1995 Venable ..... 703/27
5,515,481 A * 5/1996 Pardo ..... 358/1.18
5,557,795 A * 9/1996 Venable ..... 718/100
5,701,479 A * 12/1997 Venable et al. ..... 718/100
6,195,593 B1 * 2/2001 Nguyen ..... 700/97
6,347,857 B1 * 2/2002 Purcell et al. ..... 347/19
6,433,885 B1 * 8/2002 Verghese et al. ..... 358/1.15
6,450,607 B1 * 9/2002 Bolash et al. ..... 347/19
6,594,028 B1 * 7/2003 Hamamoto et al. ..... 358/1.15
2004/0027609 A1 * 2/2004 Isaka et al. ..... 358/1.15

FOREIGN PATENT DOCUMENTS

JP 2003-51003 A 2/2003

* cited by examiner

*Primary Examiner*—Matthew Luu
*Assistant Examiner*—Shelby Fidler
(74) *Attorney, Agent, or Firm*—Sughrue Mion, PLLC

(57) ABSTRACT

Diverse initiator modules, member modules, and terminator modules are provided to actualize various functionalities of a printer in various combinations of these modules. A data processing path controller DPC arranges a sequence of plural modules to execute a selected printing process. Each module is not informed of the structures of the other modules in combination or the details of the processing executed by the other modules. Each module that allows a relevant module to read data therefrom and each module that allows a relevant module to write data therein are designed to respectively have a specific function for the data reading and a specific function for the data writing. In response to a call from the data processing path controller DPC, these modules transfer pointers of the corresponding functions to the individual relevant modules and accordingly allow the individual relevant modules to read data therefrom and write data therein.

This arrangement of the invention ensures consistency of an additional functionality, which is to be newly incorporated in the printer, with multiple existing functionalities.

18 Claims, 13 Drawing Sheets

Fig.4

| Initiator Modules | Member Modules | | | Terminator Modules |
|---|---|---|---|---|
| I-A | M-A | M-D | M-G | T-A |
| I-B | M-B | M-E | M-H | T-B |
| I-C | M-C | M-F | M-I | T-C |

Fig.5

| Classification | Printing Process | Harness Called | Data Stream Definition |
|---|---|---|---|
| (A) | Standard Printing | Harness 1 | I-A→M-E→M-H→T-A |
| (B) | Direct Printing | Harness 2 | I-B→M-B→M-E→M-F→T-B |
| (C) | Card Printing | Harness 2 | I-B→M-C→M-E→M-F→T-B |
| (D)-1 | Nozzle Check Printing | Harness 3 | I-C→M-B→M-E→T-C |
| (D)-2 | Bidirectional Check Printing | Harness 3 | I-C→M-D→M-E→T-C |

Fig.6

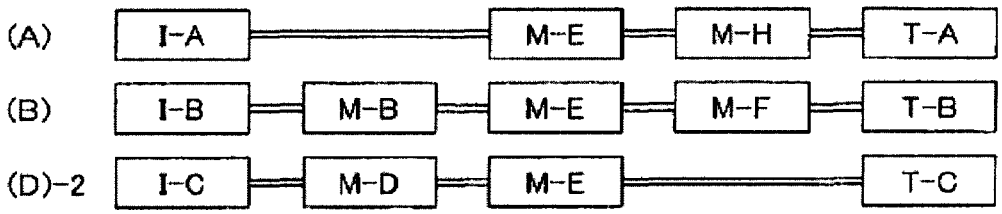

Fig.7

| Module | Allowable Number of Calls MAXC | Number of Actual Calls AC | Status SS |
|---|---|---|---|
| I-A | 1 | 1 | PROCESSING |
| I-B | 1 | 0 | STAND-BY |
| I-C | 1 | 0 | STAND-BY |
| | | | |
| M-A | 3 | 1 | PROCESSING |
| M-B | 1 | 1 | READY |
| • | • | • | |
| • | • | • | |
| M-H | 2 | 0 | STAND-BY |
| | | | |
| T-A | 1 | 1 | READY |
| T-B | 1 | 0 | STAND-BY |
| T-C | 1 | 0 | STAND-BY |

PRINTING DEVICE, PRINTING METHOD, AND PROGRAM PRODUCT THEREFOR

TECHNICAL FIELD

The present invention relates to a printing technique, and more specifically pertains to the internal configuration of a printing device to readily execute multiple different printing processes.

BACKGROUND ART

A printer or another printing device widely used as an output terminal of the computer receives data from the computer and drives a print head to create dots on a printing medium, such as printing paper, and thereby complete a printed image. The early printer has an internal character generator to expand fonts and receives only text data from the computer to implement printing. With spread of the advanced graphic processing of the computer, the printer additionally has the functionality of receiving and printing image data.

On the premise of diversity of data processed by application programs on the computer, a printer driver for each printer installed in the computer is generally used to generate print data according to the print head-scan and the paper-feed characteristics of the printer and transfer the generated print data to the printer, which then implements printing. The printer driver stores in advance required data for printing, for example, the printing resolution of the printer, the color expression including the number of color inks used in the printer, the nozzle arrangement of the print head (the number of nozzles and the nozzle pitch), and the accuracy of paper feed. Dot data representing dots to be created by the print head are then generated according to these required data. For example, in the case of an inkjet printer that uses lighter density color inks, light cyan (LC) and light magenta (LM), in addition to standard color inks, cyan (C), magenta (M), yellow (Y), and black (K) and is capable of creating three variable-size ink dots, that is, large-size, medium-side, and small-size dots, the printer driver executes rasterization and color correction of image data received from an application program and further performs halftoning to express a printed image with the six-color and three variable-size ink dots. Such print processing techniques have been proposed, for example, in Japanese Patent Laid-Open Gazette No. 2003-51003A.

With the recent advancement of peripheral devices including digital still cameras, personal digital assistants, and cell phones, there has been high demand for directly printing data of these peripheral devices without the computer processing. These peripheral devices generally have an internal CPU of the restricted processing power and an internal memory of the restricted storage capacity and accordingly have difficulties in executing rasterization, color correction, and halftoning. A proposed technique incorporates additional modules of executing rasterization, color correction, and halftoning in the printing device. The printing device receives image data in, for example, JPEG format and internally executes a series of image processing to implement printing. This printing device is also connectable with the computer to receive print data after completion of image processing from the computer and implement printing. The printing device is also capable of directly receiving image data and internally executing a required series of image processing to implement printing. The latter type of printing may be called direct printing functionality.

Addition of new functionalities, such as the direct printing functionality, to improve the conventional printing device, complicates the internal configuration of the printing device and causes difficulties in accurate execution of multiple different printing processes. There are especially difficulties in accurate parallel execution of two or more functionalities, which are not originally competing, among various functionalities of the printing device. Such difficulties undesirably extend the total processing time. Addition of any new functionality to a printing device under design requires consistency with existing modules that cover various required functionalities of the printing device. This results in extremely time-consuming development of a new printing device.

SUMMARY

The object of the invention is thus to eliminate at least one of the drawbacks of the prior art techniques discussed above and to provide the internal configuration of a printing device that readily executes multiple different printing processes.

In order to attain at least part of the above and the other related objects, the present invention is directed to a printing device that drives a print head to implement printing on a medium. The printing device includes: multiple processing modules that include a module of providing object data to be printed, a module of processing the object data for a printing operation; and a module of controlling a hardware structure including the print head to print the processed object data; a combination storage unit that stores a combination of plural processing modules selected among the multiple processing modules and mapped to each of multiple different printing processes executed by said printing device; and a printing process execution assembly that, in response to specification of one of the multiple different printing processes, actually arranges a sequence of plural processing modules corresponding to a stored combination of the plural processing modules mapped to the specified printing process, and executes the specified printing process.

The printing device of the invention provides in advance the multiple processing modules, for example, the module of providing object data to be printed, the module of processing the object data for a printing operation; and the module of controlling the hardware structure including the print head to print the processed object data. The printing device also stores in advance a combination of plural processing modules selected among the multiple processing modules and mapped to each of the multiple different printing processes. In response to specification of one of the multiple different printing processes, the printing device actually arranges a sequence of plural processing modules corresponding to a stored combination of the plural processing modules mapped to the specified printing process, and executes the specified printing process. This arrangement facilitates execution of the multiple different printing processes and desirably saves the time required for development of the printing device.

The technique of the invention is not restricted to the printing device discussed above but is actualized by a corresponding printing method, as well as by a corresponding program for printing. Any of various arrangements described below may be adopted in the printing device, the printing method, and the program for printing of the invention.

At least one of the multiple processing modules may have either of a protocol for providing a function that allows a downstream module to read data from the processing module and a protocol for writing data into the downstream module. At least one of the multiple processing modules may have either of a protocol for reading data provided by an upstream module and a protocol for providing a function that allows the upstream module to write data in the processing module. These arrangements enable each module to be designed independently of the upstream module and the downstream module.

In some combinations of modules, both the upstream module and the downstream module may provide the functions for data transmission (combination group A). In other combinations of modules, neither the upstream module nor the downstream module may provide the functions for data transmission (combination group B). One possible measure may specify the stored combinations of modules to avoid such combination groups A and B. Another available measure provides a protocol intermediate module that defines a protocol for writing data into a downstream module and a protocol for reading data provided by an upstream module. The interposition of this protocol intermediate module desirably ensures data transmission between an upstream module and a downstream module in the combination group A. Alternatively the available measures provides a function providing intermediate module that defines a protocol for providing a function that allows a downstream module to read data from the function providing intermediate module and a protocol for providing a function that allows an upstream module to write data in the function providing intermediate module. The interposition of this function providing intermediate module desirably ensures data transmission between an upstream module and a downstream module in the combination group B.

The printing process execution assembly locates the protocol intermediate module between the upstream module and the downstream module in the combination group A in the sequence of plural processing modules arranged corresponding to the stored combination of the plural processing modules. The printing process execution assembly locates the function providing intermediate module between the upstream module and the downstream module in the combination group B.

Among the multiple processing modules, a processing module that is located at a most upstream position in any combination of plural processing modules is an initiator module that does not have a protocol related to an upstream module. A processing module that is located at a most downstream position in any combination of plural processing modules is a terminator module that does not have a protocol related to a downstream module.

The initiator module may have a data storage unit that stores data for one of the multiple different printing processes. The terminator module may be an interface module that controls the hardware structure of the printing device.

In one preferable embodiment of the printing device of the invention, exclusive control information is stored with each combination of plural processing modules. The exclusive control information represents permission or prohibition of a call for each processing module in the combination, which is used and occupied by one printing process, from another printing process. The storage also includes busy information that represents whether each processing module in the combination is actually used and occupied by one printing process. In response to an external instruction for executing a selected printing process, the printing process execution assembly refers to the busy information and the exclusive control information with regard to relevant processing modules to the externally instructed printing process and prohibits execution of the externally instructed printing process, when at least one of the relevant processing modules to the externally instructed printing process is not allowed to be called from another printing process in use of one printing process and is actually used and occupied by one printing process. This arrangement readily gives permission for or places a prohibition on the use of each module, which is occupied by one printing process, for another printing process. Permission for or prohibition on the call for each processing module from another printing process may be determined unequivocally. Each processing module may have a preset allowable number of calls, which represents the maximum number of simultaneous calls from different printing processes. Each processing module may be allowed to be called from another printing process until the actual number of calls reaches the preset allowable number of calls.

Prohibition of execution of the externally instructed printing process may cancel out the externally instructed printing process or may delay execution of the externally instructed printing process until completion of the use of at least one of the relevant processing modules.

The printing device of the invention may have diverse configurations. In one embodiment of the configuration, the printing device further includes: a connector that is connectable with an external computer; and a communication unit that transmits print data expanded for printing to and from the external computer via the connector. The combination storage unit stores a specific combination of plural processing modules mapped to a specific printing process among the multiple different printing processes, which drives the print head according to the print data received via the connector to implement printing on the medium. The printing device of this configuration is used for conventional printing operations through connection with the computer.

In another embodiment of the configuration, the printing device further includes: a connector that is connectable with a peripheral device, such as an electronic still camera, a personal digital assistant, or a cell phone; and a communication unit that receives image data from the peripheral device via the connector. The combination storage unit stores a specific combination of plural processing modules mapped to a specific printing process among the multiple different printing processes, which expands the image data received via the connector to print data and drives the print head according to the print data to implement printing on the medium. The printing device of this configuration is used to receive image data from the peripheral device and directly print the expanded image data.

In still another embodiment of the configuration, the printing device further includes: a card slot that holds a memory card, which is inserted therein and has storage of image data; and an input unit that reads the image data stored in the memory card inserted in the card slot. The combination storage unit stores a specific combination of plural processing modules mapped to a specific printing process among the multiple different printing processes, which expands the read image data to print data and drives the print head according to the print data to implement printing on the medium. The printing device of this configuration is used to print images stored in the memory card inserted in the card slot.

The printing device may receive image data from a peripheral device, such as an electronic still camera, a personal digital assistant, or a cell phone, by wireless communication. The wireless communication may be, for example, infrared communication or short-range wireless communication (such as Bluetooth (registered trademark)).

The multiple different printing processes executed by the printing device of the invention may include a specific printing process of printing a dot pattern for position adjustment in bidirectional printing and another specific printing process of printing a dot pattern for nozzle check. The storage includes specific combinations of plural processing modules mapped to these specific printing processes.

The printing device is not restricted to have only the printing-related functionalities. The technique of the invention is applicable to diversity of printing devices with additional functionalities, for example, a printing device with an image reading functionality for optically reading an image and converting the optically read image into image data, a printing device with a communication functionality for establishing communication with an external communication line, and a printing device with a reproduction functionality for reproducing a moving picture of a TV receiver or a video player.

The printing device with the image reading functionality may be designed to execute a printing process of expanding the converted image data to print data and driving the print head according to the print data to implement printing on the medium, as one of the multiple different printing processes. The printing device with the communication functionality may be designed to send and receive facsimiles and automatically print e-mails. The printing device with the reproduction functionality may be designed to print the moving picture and a title of the moving picture.

BRIEF DESCRIPTION OF THE DRAWINGS

FIG. 4 shows an example of modules under control of a data processing path controller DPC;

FIG. 5 shows sequences of an initiator module, member modules, and a terminator module preset corresponding to multiple different printing processes;

FIG. 6 shows actual arrays of respective modules according to the data stream definitions of FIG. 5;

FIG. 7 shows an example of attributes set in respective modules;

BEST MODES OF CARRYING OUT THE INVENTION

Figure 1:
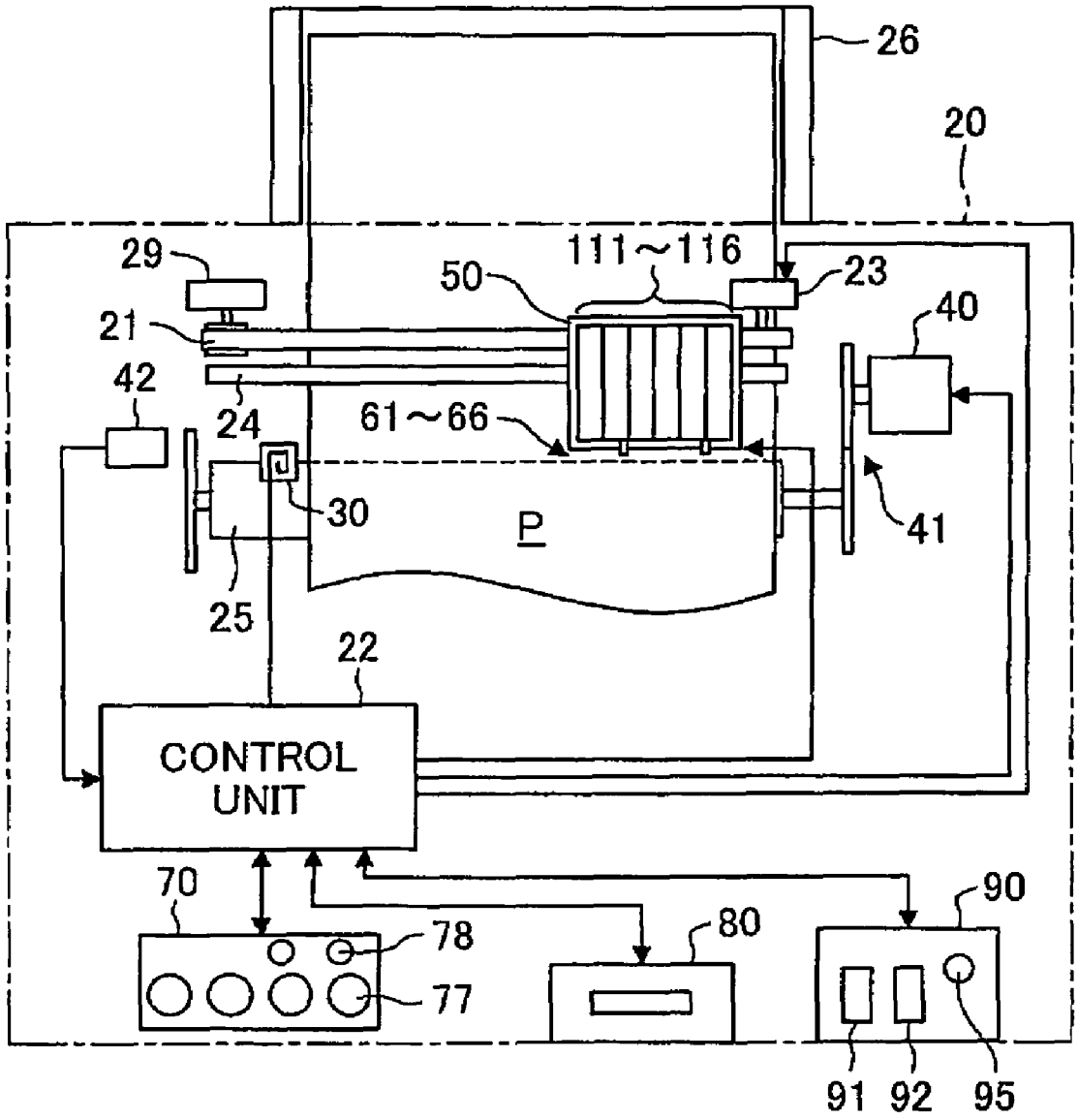
FIG. 1 schematically illustrates the configuration of operation-related components in a printer 20.
Figure 2:
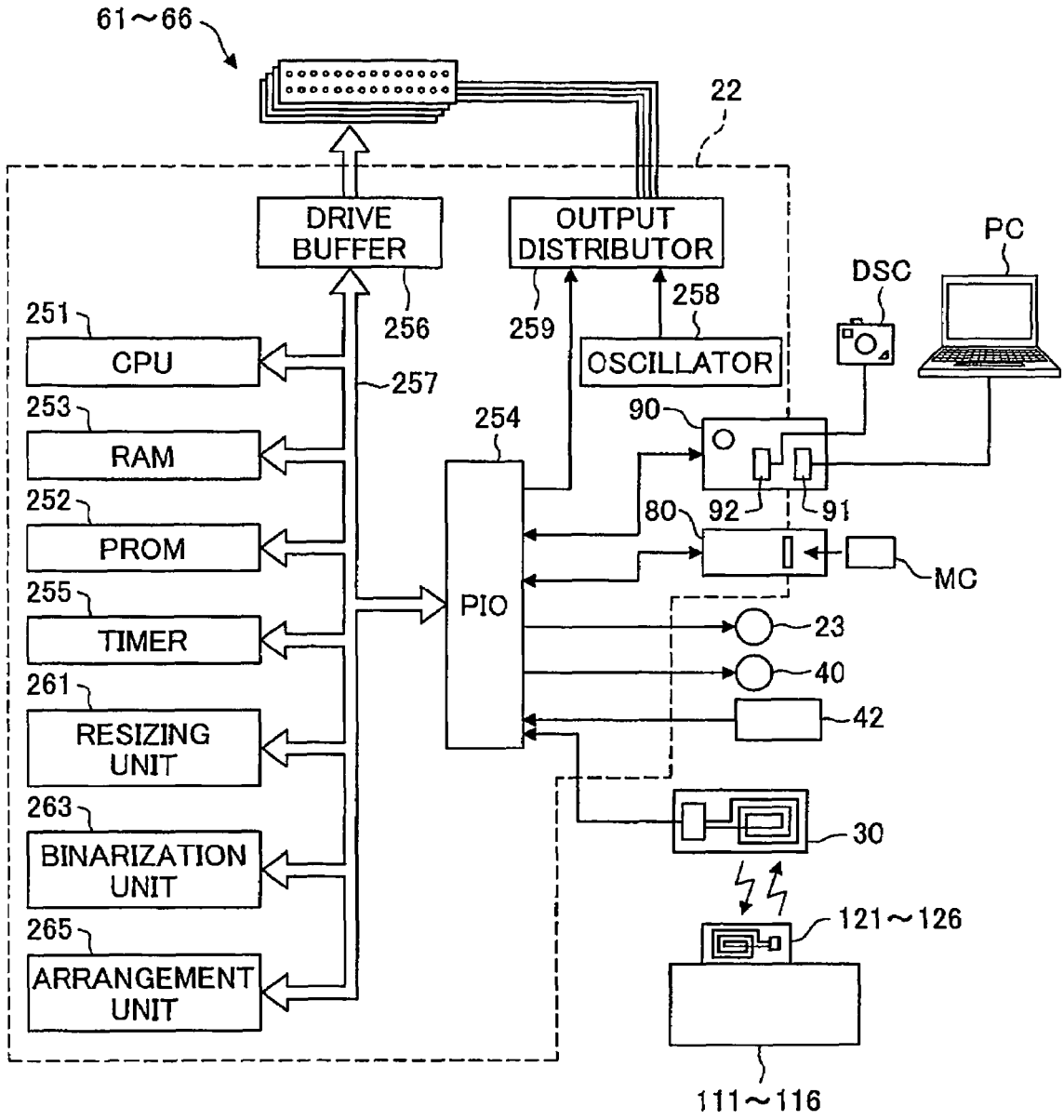
FIG. 2 is a block diagram mainly showing the internal structure of a control unit 22 included in the printer 20.

One mode of carrying out the invention is discussed below as a preferred embodiment in the following sequence:

(1) Hardware Configuration
(2) Outline of Printing Processes
(3) Software Configuration of Modules
(4) Control by Data Processing Path Controller DPC
(5) Settings in Respective Software Modules and Mutual Data Transmission
(6) Structures of Adapters
(7) Operations of Printer (1) Hardware Configuration A printer 20 of the embodiment has the hardware configuration described below. FIG. 1 schematically illustrates the configuration of operation-related components in the printer 20. FIG. 2 is a block diagram mainly showing the internal structure of a control unit 22 included in the printer 20. As illustrated in FIG. 1, the printer 20 actuates print heads 61 through 66 to eject ink droplets on printing paper P, which is fed by a paper feed unit 26 and is conveyed by a platen 25, and thereby complete a printed image on the printing paper P. The platen 25 is driven and rotated by the driving force transmitted from a paper feed motor 40 via a gear train 41. An encoder 42 detects the rotation angle of the platen 25. The print heads 61 through 66 are mounted on a carriage 50 that moves back and forth along the width of the printing paper P. The carriage 50 is linked to a conveyor belt 21 driven by a stepping motor 23. The conveyor belt 21 is an endless belt and is spanned between the stepping motor 23 and a pulley 29 located at an opposite end. The rotation of the stepping motor 23 drives the conveyor belt 21 to reciprocate the carriage 50 along a conveyor guide 24.

Six color ink cartridges 111 through 116 are mounted on the carriage 50. The six color ink cartridges 111 through 116 basically have an identical structure but store inks of different compositions, that is, different color inks, in respective ink chambers. The ink cartridges 111 through 116 respectively store black ink (K), cyan ink (C), magenta ink (M), yellow ink (Y), light cyan ink (LC), and light magenta ink (LM) therein. The light cyan ink (LC) and the light magenta ink (LM) are lighter color inks adjusted to have approximately ¼ of the dye densities of the cyan ink (C) and the magenta ink (M). Storage modules 121 through 126 are attached to the respective ink cartridges 111 through 116. The storage modules 121 through 126 transmit data to and from the control unit 22 of the printer 20 by wireless communication.

The printer 20 has a receiver transmitter unit 30 to establish wireless communication with the storage modules 121 through 126 for data transmission. The receiver transmitter unit 30, as well as other electronic parts, for example, the paper feed motor 40, the stepping motor 23, and the encoder 42, are connected to the control unit 22. The control unit 22 is also linked with an operation panel 70 and a card slot 80 that are provided on the front face of the printer 20 and with a group of connectors 90 to establish connection with various external devices. The operation panel 70 has diverse operation switches 77 and LEDs 78 for printing-related settings. The card slot 80 is a multi-slot to receive multiple different memory cards including SmartMedia and CompactFlash (registered trademarks). The connector group 90 includes a USB connector 91 for connection with a computer, another USB connector 92 for connection with a peripheral device, for example, a digital still camera or a cell phone, and an infrared communication port 95 for infrared communication. The two USB connectors 91 and 92 are provided as different ports, since one port makes the printer 20 function as a slave and the other port makes the printer 20 function as a master.

As illustrated in FIG. 2, the control unit 22 includes a CPU 251 that takes charge of overall control of the printer 20, a PROM 252 that stores control programs, a RAM 253 that is used for temporary data storage, a resizing unit 261 that regulates the hardware structure to resize images, a binarization unit 263 that executes binarization (halftoning) of images, an arrangement unit 265 that arranges data according to nozzle arrays on the print heads 61 through 66, a PIO 254 that works as an interface with external devices, a timer 255 that manages the time, and a drive buffer 256 that stores data for actuating the print heads 111 through 116. These circuit elements are mutually connected via a bus 257. The control unit 22 also includes an oscillator 258 and an output distributor 259, in addition to these circuit elements. The output distributor 259 distributes pulse signals output from the oscillator 258 into common terminals of the six print heads 61 through 66. In response to driving pulses received from the output distributor 259, the print heads 61 through 66 activate nozzles to eject ink droplets according to ink on-off data (data representing ink ejection or no-ejection) received from the drive buffer 256.

The stepping motor 23, the paper feed motor 40, the encoder 42, the receiver transmitter unit 30, the operation panel 70, the card slot 80, and the connectors 90 are connected to the PIO 254 of the control unit 22. The PIO 254 establishes data communication with the storage modules 121 through 126 of the ink cartridges 111 through 116 via the receiver transmitter unit 30. The control unit 22 is accordingly informed of the remaining amounts of inks in the respective ink cartridges 111 through 116 by data communication. At a predetermined timing, for example, in response to a power-off operation of the printer 20, ink consumptions (that is, the remaining amounts of inks) computed in the control unit 22 are written into the storage modules 121 through 126 of the respective ink cartridges 111 through 116.

(2) Outline of Printing Processes

The printer 20 having the hardware configuration discussed above executes several different printing processes described below.

(A) Printing from Computer

Printing may be executed in response to a print command from an application program running on a computer PC. The application program provides image data to be printed, calls a printer driver incorporated in an operating system, and transfers the image data to the called printer driver. The printer driver makes the received image data go through a series of image processing, for example, rasterization, color correction, halftoning, and data arrangement, to convert the image data into print data that are printable by the printer 20 corresponding to the printer driver. The converted print data are related to the compositions of inks (the number and the types of color inks) used in the printer 20, the available sizes of ink droplets (large, medium, small), and the number of nozzles and the nozzle pitch in the respective print heads 61 through 66. The printer 20 simply stores the print data received via the USB connector 91 and transfers the stored print data to the print heads 61 through 66 via the drive buffer 256 at an adequate timing to complete multi-colored printing. In synchronism with ejection of ink droplets from the print heads 61 through 66, the stepping motor 23 is driven to move the carriage 50 (main scans) and the paper feed motor 40 is driven to convey the printing paper P (sub-scans). The printer 20 may communicate with an external peripheral device having infrared communication functionality, such as a cell phone or a personal digital assistant, via the infrared communication port 95. The printing process of image data received from the cell phone or another peripheral device is similar to the printing process of image data received from a digital still camera DSC discussed below, except transfer of the image data, and is thus not specifically described here.

(B) Printing from Digital Still Camera

Printing from a digital still camera DSC is generally executed as direct printing. The printer 20 functions as a master and establishes data communication with the digital still camera DSC connected to the USB connector 92. On establishment of data communication between the digital still camera DSC and the printer 20, the user operates the operation switches 77 on the operation panel 70 of the printer 20 to specify desired print settings (for example, the desired number of copies). The digital still camera DSC then sends image data, for example, in a JPEG format. The printer 20 receives the image data via the USB connector 92, processes the received image data by the resizing unit 261, the binarization unit 263, and the arrangement unit 265 to generate print data, and drives the print heads 61 through 66, the stepping motor 23, and the paper feed motor 40 according to the print data to complete printing.

(C) Printing from Memory Card

When a memory card MC inserted in the card slot 80 has storage of image data, the printer 20 reads the image data to implement printing. This card printing process is similar to the process of printing image data from the digital still camera DSC discussed above, except extraction of image data. In the card printing process, in response to detection of insertion of the memory card MC into the card slot 80, the printer 20 reads image data from the memory card MC and prints the user's selected image data in the user's specified print settings through the operations of the operation switches 77. The series of image processing, for example, resizing and binarization of images, is identical with that executed in the printing process from the digital still camera DSC.

(D) Maintenance Printing

Maintenance printing is executed for the purpose of maintenance of the printer 20. The maintenance printing includes demo printing to print a demo image, nozzle check printing to check the nozzle conditions, and bidirectional check printing to adjust bidirectional printing. Image data to be printed in these maintenance printing operations are stored in advance in the printer 20. The image data to be printed for maintenance are basically adjusted to the structure of the print heads 61 through 66. The printer 20 executes maintenance printing in response to the user's operations of the operation switches 77 on the operation panel 70. For example, a power-on operation with a press of a specified one of the operation switches 77 triggers demo printing. Simultaneous depression of specific two of the operation buttons 77 triggers nozzle check printing. In response to specification of one of the maintenance printing operations, the printer 20 reads a dot pattern from the PROM 252, outputs the dot pattern to the print heads 61 through 66 in synchronism with actuation of the stepping motor 23 and the paper feed motor 40 to implement demo printing or another image printing required for the purpose of maintenance.

The procedure of forming a printed image on the printing paper P is briefly summarized here. In response to selection of an object image to be printed by the printer 20 and generation of processed print data through rasterization, color conversion, and halftoning, the control unit 22 of the printer 20 detects the position of the carriage 50 based on the driving quantity of the stepping motor 23 and the position of the printing paper P based on the data from the encoder 42 and outputs the ink on-off data to the drive buffer 256 at an adequate synchronization timing. The control unit 22 then drives the output distributor 259 and causes the nozzles of the print heads 61 through 66 to eject ink droplets in required positions. This series of operations is sequentially repeated from the top end of the printing paper P to complete a printed image on the printing paper P.

(3) Software Configuration of Modules

The control unit 22 controls the whole hardware structure of the printer 20 and the various printing processes described above. The CPU 251 executes the programs stored in the PROM 252 to actualize the operations of the control unit 22 and the respective printing processes. The description below regards the programs executed by the control unit 22, that is, the software configuration. The printer 20 of this embodiment divides the printing-related software structure into multiple modules and defines the data transmission between the multiple modules to readily actualize the multiple different printing processes described above.

Figure 3:
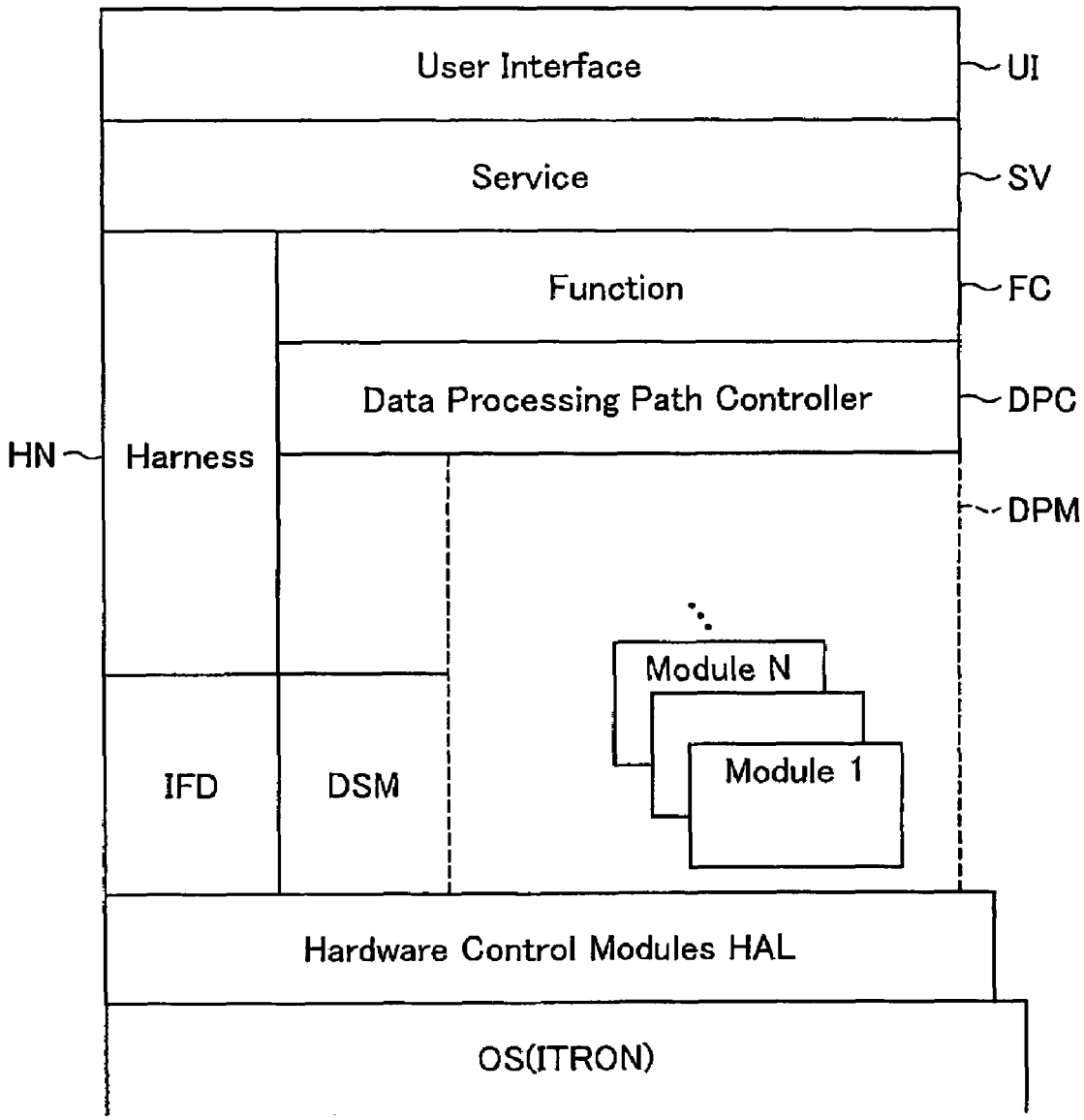
FIG. 3 schematically illustrates the printing-related software configuration of the printer 20.
Figure 8:
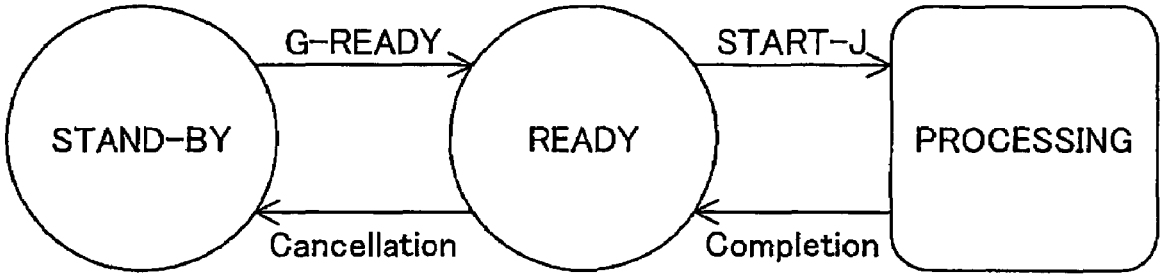
FIG. 8 shows a transition of status SS in a module called.

FIG. 3 schematically illustrates the printing-related software configuration of the printer 20. In an actual printing process, required modules are rearranged as discussed later. FIG. 3 accordingly does not show the software configuration corresponding to any specific printing process actually executed but roughly shows the processing software configuration in the printer 20. As shown in FIG. 3, an operating system ITRON runs on the base of the software group controlling the printer 20. All the other software components are developed on the operating system ITRON, and required libraries are provided in the ITRON environment.

Multiple hardware control modules HAL are provided on the operating system. These hardware control modules HAL control the resizing unit 261, the binarization unit 263, the arrangement unit 265, and diverse hardware components accessible via the PIO 254. Above the hardware control modules HAL, there is a group of processing modules DPM provided to execute various series of processing by software. A data processing path controller DPC given as an exclusive module selects required modules among the group of processing modules DPM, as well as required modules among the hardware control modules HAL to determine a processing flow.

Functions FC, a service SV, and a user interface UI are sequentially constructed above the processing module group. One of the functions FC is called, for example, in the process of printing an image stored in the memory card MC inserted in the card slot 80. The functions FC implement a group of additional functionalities that are different from basic functionalities of the printer, such as external communication. The service SV cooperates with the upper user interface UI to receive requests from the operation switches 70 of the operation panel 70 and from various external devices connected to the connector group 90 and to trigger the corresponding printing processes. The service SV receives an external request from the user interface UI and uses an adequate harness HN to call a corresponding function FC, the data processing path controller DPC, and other required modules. Multiple harnesses HN are provided as functional units, since the printer 20 includes various software-processing functionalities, as well as hardware interfaces IFD related to these functionalities and a status management module DSM that manages the statuses of various hardware components. The use of the harnesses HN as the functional units enables the data processing path controller DPC to readily call required software modules, while ensuring consistency of interfaces and facilitating execution of various functionalities of the printer 20.

(4) Control by Data Processing Path Controller DPC

The data processing path controller DPC executes series of control discussed below. In response to the user's operation of the printer 20 via the user interface UI, the service SV calls a corresponding one of the lower harnesses HN. This call activates the data processing path controller DPC. There are APIs defined in the form of functions like a LockProcess function, which instructs the data processing path controller DPC to reserve required modules. The upper layer uses these APIs to control the data processing path controller DPC. The data processing path controller DPC is called by one of the harnesses HN as the functional units to start working and arrange a combination of required modules to execute the processing specified by the harness HN.

FIG. 4 shows an example of modules under control of the data processing path controller DPC. As shown in FIG. 4, the modules are roughly divided into three groups in the printer 20. One group includes initiator modules that are always located at the head in any data processing flow. In the illustrated example of FIG. 4, this group includes three initiator modules I-A to I-C. Another group includes terminator modules that are always located at the end in any data processing flow, contrary to the initiator modules. In the illustrated example of FIG. 4, this group includes three terminator modules T-A to T-C. The number of the initiator modules and the number of the terminator modules depend upon the number of printing processes to be executed. The last group includes member modules that are located in the middle between the head and the end in the data processing flow. In the illustrated example of FIG. 4, this group includes nine member modules M-A to M-I.

A combination of an initiator module, member modules, and a terminator module is determined in advance corresponding to each printing process to be executed. One example of such combinations is given in FIG. 5. FIG. 5 defines combinations and sequences (data streams) of modules to implement the printing processes (A) through (D) described previously. For example, the data stream definition of the standard printing process (A) includes an initiator module I-A at the head and member modules M-E and M-H in this order and a terminator module T-A at the end. FIG. 6 shows actual arrays of respective modules according to the data stream definitions of FIG. 5.

(5) Settings in Respective Software Modules and Mutual Data Transmission

The description regards the settings in respective modules combined by the data processing path controller DPC to execute an actual flow of data processing, as well as mutual data transmission of the respective modules. The data processing path controller DPC may select an identical module for different combinations corresponding to different printing processes, as clearly shown in the example of FIG. 6. Each module is designed without any consideration on its position in the data stream definition corresponding to a specific printing process, a source module of data reception, and a destination module of data transfer. The settings in the respective modules and the mechanism of their mutual data transmission are accordingly explained.

Several attributes are defined in advance for each module. FIG. 7 shows an example of attributes set in respective modules. The attributes include allowable number of calls MAXC, number of actual calls AC, and status SS. The allowable number of calls MAXC set in each module represents the maximum number of different printing processes that are allowed to call the module simultaneously. Some processes are simultaneously executable in the printer 20. With the increased complexity of printing processes, there is a significant difficulty in managing information on simultaneously executable combinations of modules. In the structure of this embodiment, each module called and combined for a requested process by the data processing path controller DPC is accordingly designed to have information representing the allowable number of simultaneous calls. The data processing path controller DPC reserves the use of each module required for a requested process by a G-READY function and subsequently instructs each module to start the requested process by a STARP-J function as discussed later. Each module called by the G-READY function refers to the allowable number of calls MAXC and the number of actual calls AC and, in the case of any vacancy, sets the status SS to READY to accept the requested process. The module returns an argument (explained later) to the data processing path controller DPC and increments the number of actual calls AC by one. The module having the number of actual calls AC called and incremented to reach the allowable number of calls MAXC can not respond affirmatively to any further call from the data processing path controller DPC. In such cases, in response to another call by the G-READY function, the module sends back a return 'Failure' to the data processing path controller DPC.

The status SS of each module called is changeable in three different states 'STAND-BY', 'READY', and 'PROCESSING'. The module in the 'STAND-BY' status can receive a call from the data processing path controller DPC. The module in the 'READY' status can accept a call from the data processing path controller DPC by the G-READY function to execute a requested job. The module in the 'PROCESSING' status is currently executing a requested job in response to a start command by the START-J function from the data processing path controller DPC. The status SS is returned to its original state on completion of the requested job or in response to cancellation of the job.

A combination of modules for a requested process is arrayed in a sequence specified by the data processing path controller DPC to form a data processing flow. Each module adopts either a stream read function or a stream write function for data transmission. The stream read function is used to read data provided by an upstream module, whereas the stream write function is used to write data into a downstream module. When a downstream module reads out data, an upstream module providing the data is expected to know the location of data reading (the position of a pointer). When an upstream module writes data, on the other hand, a downstream module receiving the data is expected to know the location of data writing (the position of a pointer). The modules that provide the stream read function and the stream write function are differentiated from the modules that use the stream read function and the stream write function to actually execute data reading and data writing. This constructs the mechanism of smooth data transmission, regardless of the combinations of modules.

The modules are thus classified in types by the functionality of the upstream module (that is, the functionality on the downstream module) and the functionality of the downstream module (that is, the functionality on the upstream module). The functionalities on the downstream module include:

Type A: Functionality of providing the stream read function; and

Type B: Functionality of calling the stream write function.

The functionalities on the upstream module include:

Type a: Functionality of calling the stream read function; and

Type b: Functionality of providing the stream write function.

Figure 9:
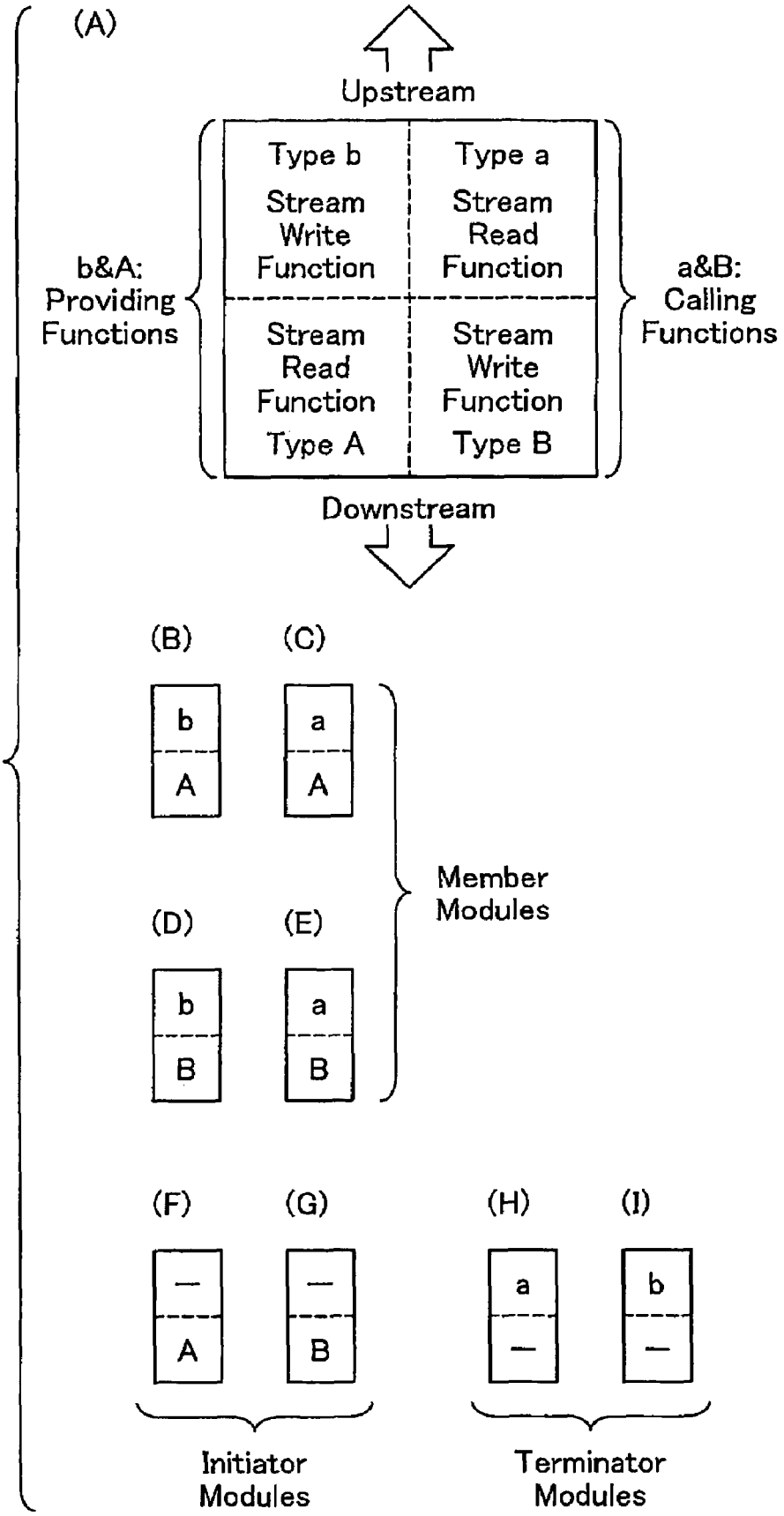
FIG. 9 shows combinations of types of respective modules.

FIG. 9 (A) shows combinations of these functionality types. The member modules have four combinations of functionality types, that is, the functionality of either the type A or the type B as the upstream module (the functionality on the downstream module) and the functionality of either the type 'a' or the type 'b' as the downstream module (the functionality on the upstream module). FIG. 9 (B) through (E) show member modules having these four combinations of the functionality types. The combination of the functionality types in each module depends upon the processing executed by the module. It is preferable, in principle, that the module that stores data obtained by the internal processing in an inner buffer is designed as the module having the functionality of the type B.

The initiator module is always located at the head in the data processing flow and is thus not required to have any functionality on an upstream module. Namely the initiator module does not have the functionality of transferring data to or receiving data from to the upstream module and has only the functionality of either the type A or the type B. The initiator modules of the respective types are shown in FIG. 9 (F) and (G). The terminator module is, on the other hand, always located at the end in the data processing flow and is thus not required to have any functionality on a downstream module. Namely the terminator module does not have the functionality of transferring data to or receiving data from the downstream module and has only the functionality of either the type 'a' or the type 'b'. The terminator modules of the respective types are shown in FIG. 9 (H) and (I).

In response to a command of executing a selected printing process given by a corresponding harness HN, the data processing path controller DPC refers to the table shown in FIG. 5 and specifies modules to be combined according to the data stream definition stored in this table. The data processing path controller DPC then calls the respective specified modules by the G-ready function to reserve the use of these modules. Each of the modules called refers to the allowable number of calls and the number of actual calls and sends back four arguments of the G-READY function set to specified values as a response to the call from the data processing path controller DPC. The data processing path controller DPC gives the following four arguments [X1, IX1, Y1, IY1] of the G-READY function in the call:

X1: Each of the type-A initiator modules and the type-A member modules providing the stream read function sends back this argument set to a pointer of the stream read function. Each of the terminator modules, the type-B initiator modules, and the type-B member modules sends back this argument set to 'NULL'. Here 'NULL' is a variable representing no specification.

IX1: Each of the type-A initiator modules and the type-A member modules providing the stream read function sends back this argument set to a context ID, which is to be specified for a call of the stream read function. Each of the terminator modules, the type-B initiator modules, and the type-B member modules sends back this argument set to the value '0'. Each module is designed to send back the context ID, since one identical module may be used simultaneously by two different processes. The data processing path controller DPC uses the received context ID to identify each process when instructing each module to start or terminate the process.

Y1: Each of the type-b terminator modules and the type-b member modules providing the stream write function sends back this argument set to a pointer of the stream write function. Each of the initiator modules, the type-a terminator modules, and the type-a member modules sends back this argument set to 'NULL'.

IY1: Each of the type-b terminator modules and the type-b member modules providing the stream write function sends back this argument set to a context ID, which is to be specified for a call of the stream write function. Each of the initiator modules, the type-a terminator modules, and the type-a member modules sends back this argument set to the value '0'.

Figure 10:
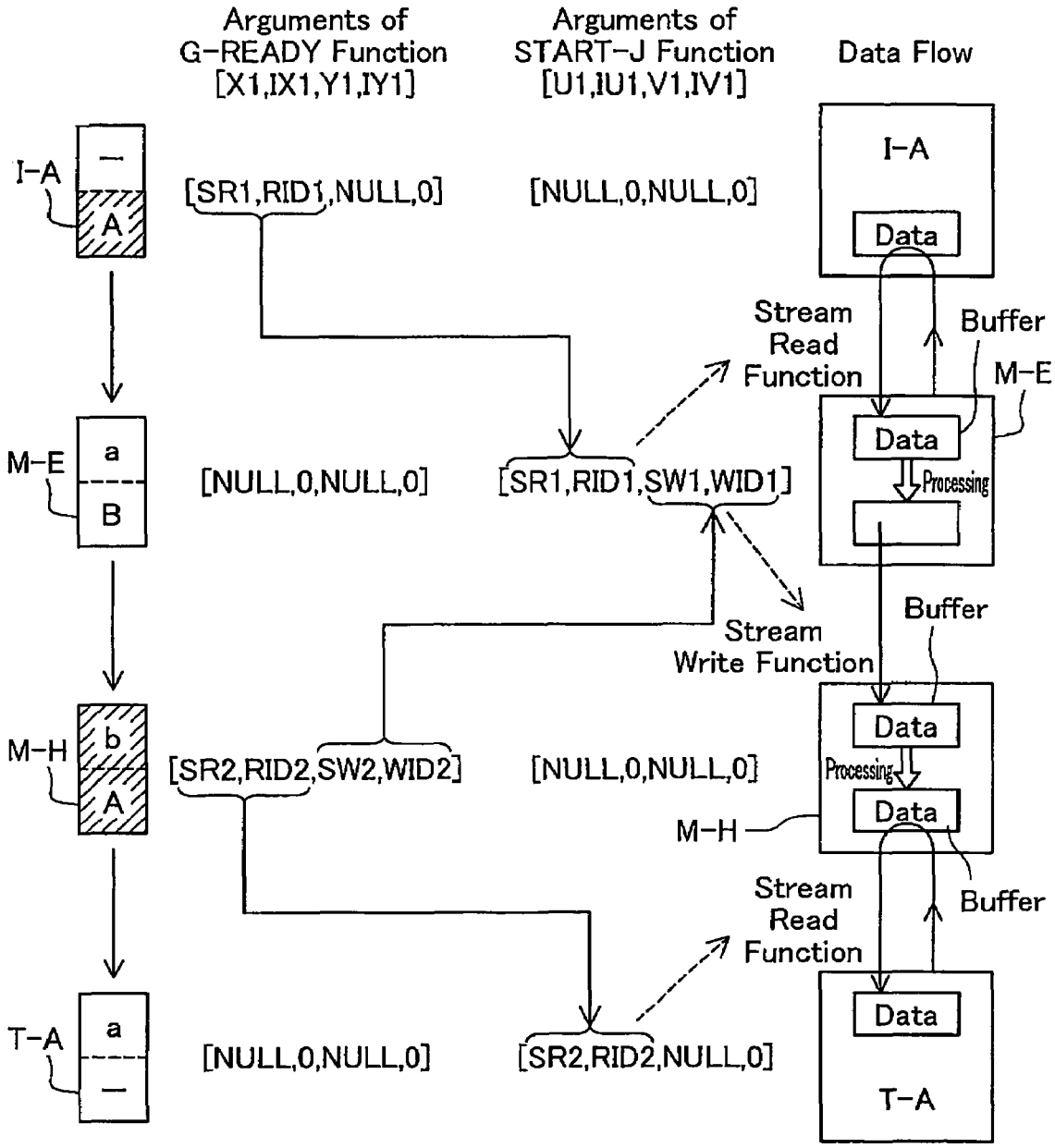
FIG. 10 shows types of respective modules and arguments passed by a G-READY function and a START-J function.

FIG. 10 shows the types of respective specified modules and the arguments passed by the G-READY function in the standard printing process (A) among the printing processes shown in FIG. 5. In the illustrated example of FIG. 10, the modules providing either of the stream read function and the stream write function are hatched. The initiator module I-A, the member module M-E, the member module M-H, and the terminator module T-A are respectively a type-A module, a (type-B+type-a) module, a (type-A+type-b) module, and a type-a module. In response to a call from the data processing path controller DPC by the G-READY function, the initiator module I-A providing the stream read function sends back a pointer SR1 and a context ID 'RID1' of the stream read function as effective arguments to the data processing path controller DPC. The (type-B+type-a) member module M-E does not provide any function and thus sends back no effective arguments. The member module M-H providing both the stream read function and the stream write function sends back a pointer SR2 and a context ID 'RID2' of the stream read function and a pointer SW1 and a context ID 'WID1' of the stream write function as effective arguments. The type-a terminator module T-A does not provide any function and thus sends back no effective arguments.

The data processing path controller DPC receives these arguments sent back from the respective specified modules and calls the respective modules by the START-J function at an adequate timing to instruct these modules to start the selected process. The data processing path controller DPC gives the following four arguments [U1, IU1, V1, IV1] of the START-J function in the call:

U1: This argument gives the pointer of the stream read function used by each module. The pointer of the stream read function is set by one of the type-A initiator modules and the type-A member modules located in the upstream. This argument is set to NULL in the call for any of the initiator modules, the type-b terminator modules, and the type-b member modules.

IU1: This argument gives the context ID to be specified by each module for the use of the stream read function. The context ID is set by one of the type-A initiator modules and the type-A member modules located in the upstream. This argument is set to the value '0' in the call for any of the initiator modules, the type-b terminator modules, and the type-b member modules.

V1: This argument gives the pointer of the stream write function used by each module. The pointer of the stream write function is set by one of the type-b terminator modules and the type-b member modules located in the downstream. This argument is set to NULL in the call for any of the terminator modules, the type-A initiator modules, and the type-A member modules.

IV1: This argument gives the context ID to be specified by each module for the use of the stream write function. The context ID is set by one of the type-b terminator modules and the type-b member modules located in the downstream. This argument is set to the value '0' in the call for any of the terminator modules, the type-A initiator modules, and the type-A member modules.

FIG. 10 also shows the arguments passed by the START-J function in the call for respective specified modules in the standard printing process (A). The pointer of the stream read function set by an upstream module is passed to a downstream module, while the pointer of the stream write function set by a downstream module is passed to an upstream module. As shown in the right end of FIG. 10, a downstream module uses the pointer of the stream read function set by an upstream module to read out data. An upstream module uses the pointer of the stream write function set by a downstream module to write data. This arrangement ensures the smooth data flow, although each module is not informed of the conditions for writing own data or reading out required data until a call from the data processing path controller DPC.

(6) Structures of Adapters

Figure 11A:
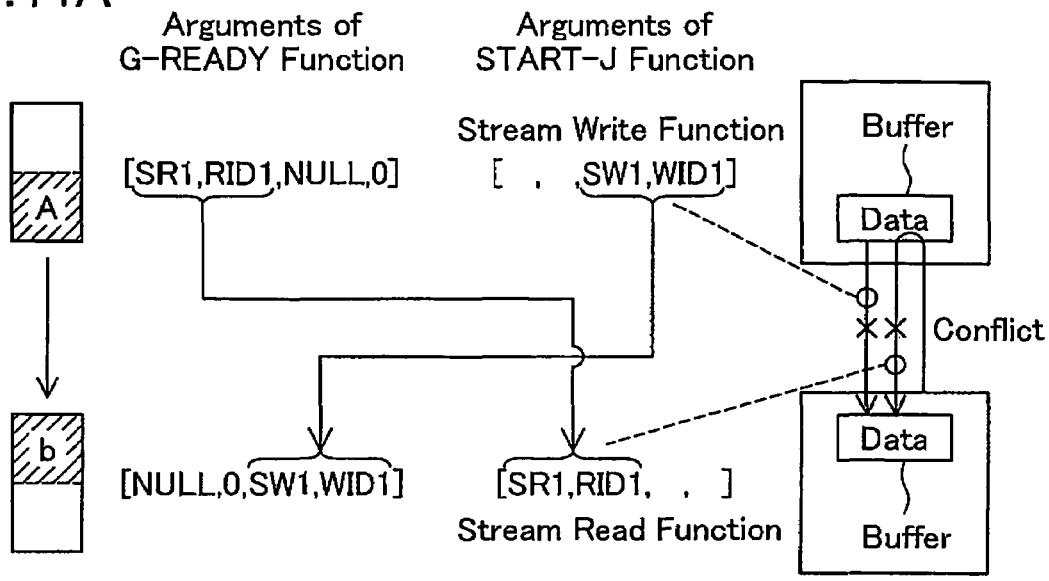
FIGS. 11A and 11B show a combination of an upstream module and a downstream module both providing a stream read function and a stream write function, as well as the structure of an adapter ADP1 applicable to this combination.
Figure 11B:
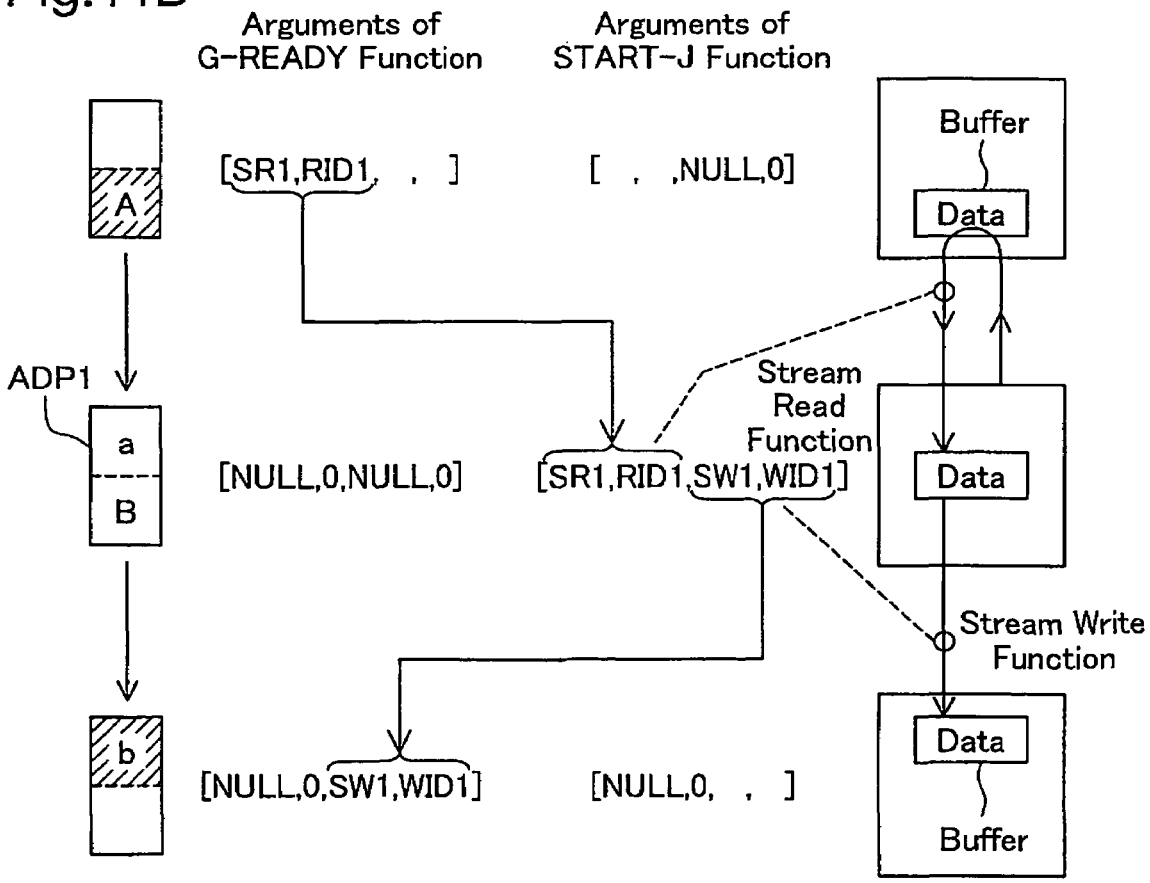
Figure 12A:
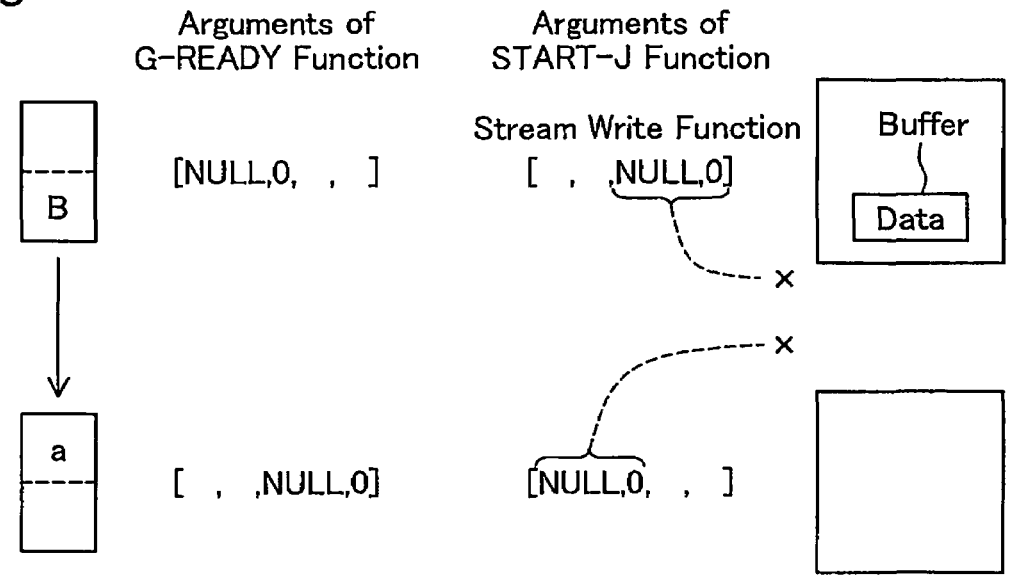
FIGS. 12A and 12B show a combination of an upstream module and a downstream module neither providing the stream read function or the stream write function, as well as the structure of an adapter ADP2 applicable to this combination.
Figure 12B:
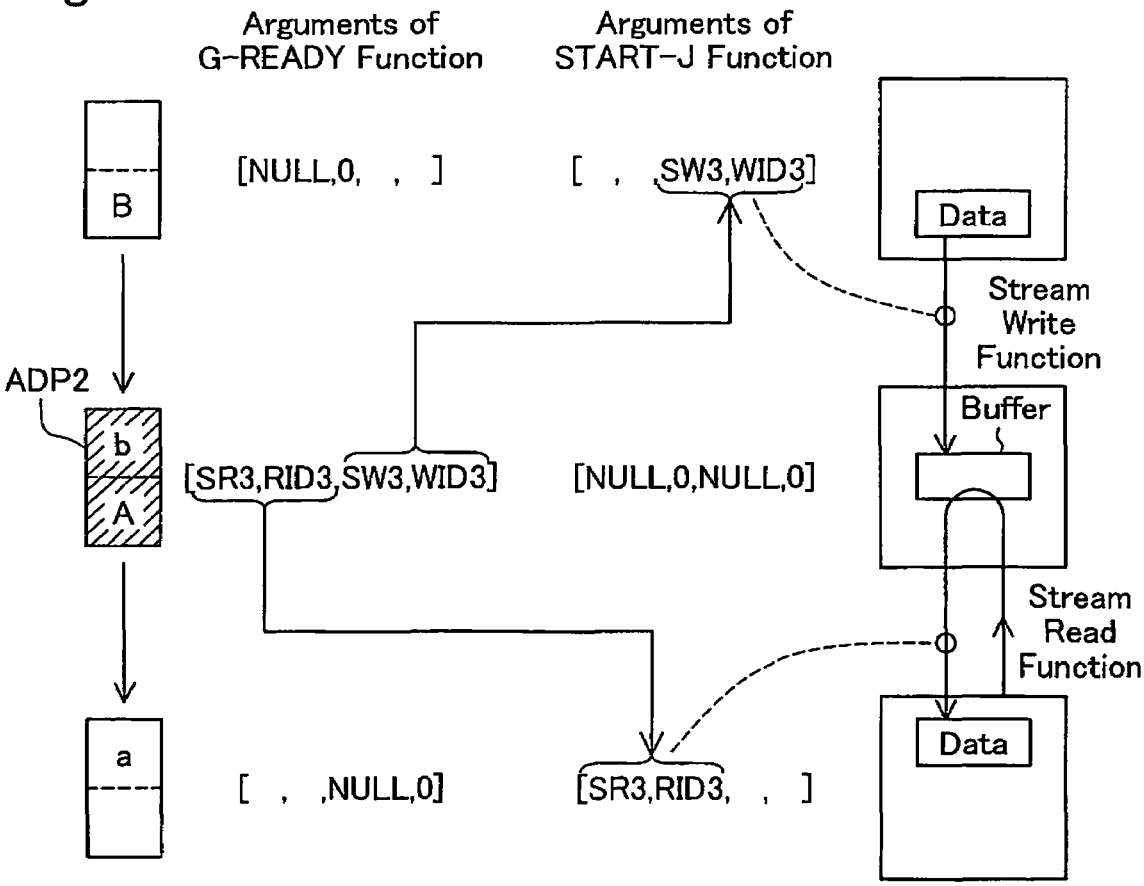

The respective modules are designed according to the rules discussed above, but there is no limitation in arrangement of modules. In some combinations of modules selected by the data processing path controller DPC, both an upstream module and a downstream module provide the stream read function and the stream write function. In other combinations, neither an upstream module nor a downstream module provides the stream read function or the stream write function. FIG. 11A shows a former example, and FIG. 12A shows a latter example. In the former case, an adapter module ADP1 is inserted between the upstream and downstream modules as shown in FIG. 11B. The adapter module ADP1 has a type-a function of receiving the pointer of the stream read function from the upstream module and a type-B function of receiving the pointer of the stream write function from the downstream module. This adapter module ADP1 corresponds to the 'protocol intermediate module' of the invention. In the latter case, another adapter module ADP2 is inserted between the upstream and downstream modules as shown in FIG. 12B. The adapter module ADP2 has a type-b function of providing the pointer of the stream write function to the upstream module and a type-A function of providing the pointer of the stream read function to the downstream module. This adapter module ADP2 corresponds to the 'function providing intermediate module' of the invention.

The data processing path controller DPC provides these adapters ADP1 and ADP2 and inserts a required adapter in any of the above combinations of modules. Each module is thus not required to be informed of the characteristics of the other modules to be combined with. This technique of the embodiment requires only two different adapters. In the structure of this embodiment, unlike the member modules, the initiator modules do not have the upstream function and the terminator modules do not have the downstream function. In one modified structure, like the member modules, all the initiator modules and the terminator modules may have both the upstream function and the downstream function. The data processing path controller DPC locates an initiator adapter at the head in an array of modules and a terminator adapter at the end in the array of modules. This modification practically requires only the member modules for the data processing.

(7) Operations of Printer

Figure 13:
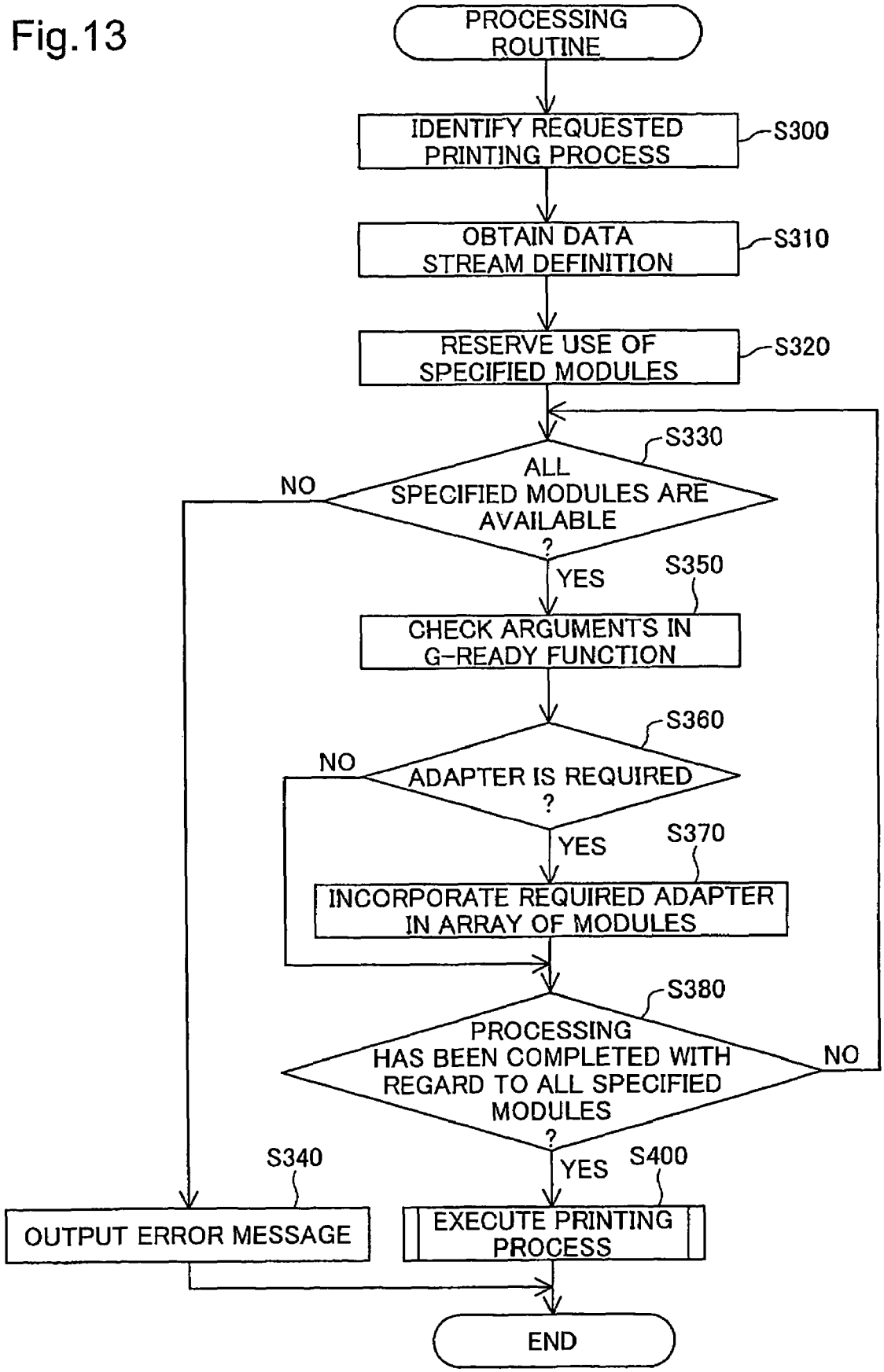
FIG. 13 is a flowchart showing a series of processing executed by an internal CPU 251 in the control unit 22 of the printer 20.

The printer 20 executes the actual series of operations discussed below. FIG. 13 is a flowchart showing a series of processing executed by the internal CPU 251 in the control unit 22 of the printer 20. On completion of initialization in response to a power-ON operation of the printer 20, the control unit 22 stands by until reception of a print request from any harness. In response to a print request from a harness, the control unit 22 activates the processing flow of FIG. 13 to identify the harness and a requested printing process (step S300). The subsequent series of processing is equivalent to the control executed by the data processing path controller DPC described above. The printing processes requested by the harness are shown in the table of FIG. 5. The data processing path controller DPC refers to this table and obtains the data stream definition corresponding to the requested printing process (step S310). The data stream definition specifies modules to be combined for the requested printing process. The data processing path controller DPC then sends the G-READY function to the respective specified modules to reserve the use of these modules (step S320). Each specified module refers to the allowable number of calls MAXC and the number of actual calls AC in the table of FIG. 7 and sends back a response representing availability or unavailability for the requested printing process. The data processing path controller DPC receives the responses from the respective specified modules and determines whether all the specified modules by the data stream definition are currently available (step S330). When there is any unavailable module, the data processing path controller DPC outputs an error message (step S340) and terminates this processing routine. In one possible modification, the data processing path controller DPC may wait until the unavailable module completes the current printing process and becomes available, instead of outputting an error message.

When all the specified modules are currently available, the data processing path controller DPC checks the settings of the arguments in the G-READY function used for the call of the respective modules (step S350) and determines whether the specified combination of the modules requires an adapter (step S360). The data processing path controller DPC calls the required adapter as appropriate and incorporates the adapter in the specified combination of the modules (step S370). The functions of the adapters are shown in FIGS. 11A, 11B, 12A, and 12B. The above series of processing is repeated until completion of the check for the combinations of the arguments in the G-READY function (step S380). On completion of the processing with regard to all the specified modules, the processing flow goes to a printing process (step S400).

Figure 14:
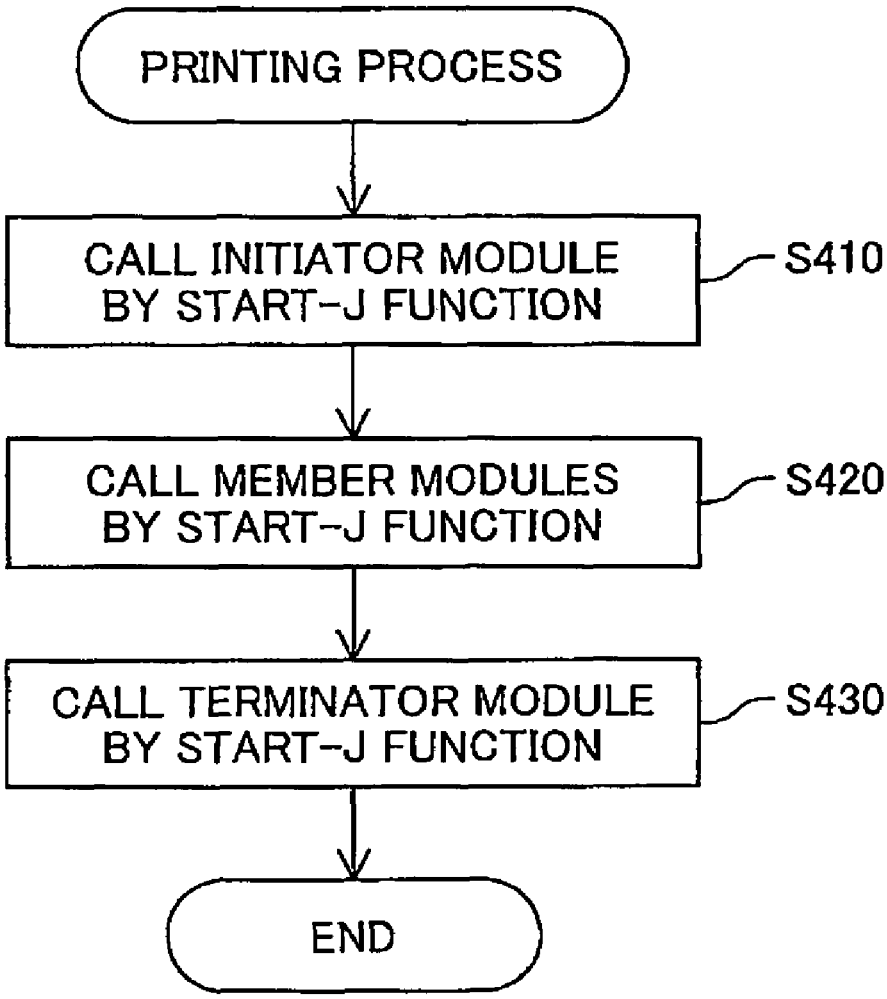
FIG. 14 is a flowchart showing a general printing process.

The details of the printing process are shown in FIG. 14 and are explained with the combination of the modules shown in FIG. 10. In the printing process, the data processing path controller DPC first calls the initiator module I-A by the START-J function (step S410). The START-J function in the call for the initiator module I-A has the arguments [NULL, 0, NULL, 0]. The initiator module I-A does not read or write data from or into another module, but only provides a downstream module with the pointer of the stream read function.

After the call for the initiator module I-A, the data processing path controller DPC calls the member modules M-E and M-H by the START-J Function (step S420). The START-J function in the call for the member module M-E has the arguments [SR1, RID1, SW1, WID1]. The member module M-E receives the pointers of both the stream read function and the stream write function. The START-J function in the call for the member module M-H has the arguments [NULL, 0, NULL, 0]. The member module M-H does not read or write data from or into another module.

The member module M-E receives the pointer of the stream read function and calls the stream read function. The stream read function has arguments [RID, *BUFF, LEN, ST], which are defined as:

RID is a context ID and is used to identify the processing.

*BUFF is a pointer representing a head address of a buffer that stores data read out by the stream read function.

LEN is a variable representing the length of the read-out data.

ST is a variable representing the status of the stream read function, either continuance or termination.

The member module M-E executes this stream read function, which is provided by an upstream module (the initiator module I-A). The upstream module, which provides data to be read out, defines the stream read function. In response to a call of the stream read function from a downstream module (the member module M-E), the downstream module is informed of the read of data having a length LEN from a buffer BUFF under management of the upstream module and the current status according to the arguments set in the stream read function. When the status ST is 'continuance', the downstream module repeats execution of the stream read function. When the status ST is 'termination', the downstream module is informed of the end of data provided by the upstream module and terminates the call of the stream read function for the upstream module.

The member module M-E processes the data read from the upstream module by the stream read function and simultaneously executes the stream write function to write the processed data. The arguments of the stream write function are basically the same as the arguments of the stream read function. The member module M-E executes this stream write function, which is provided by a downstream module (the member module M-H). The downstream module, in which data are written, defines the stream write function. In response to a call of the stream write function from an upstream module (the member module M-E), the upstream module writes data having a length LEN into a buffer BUFF under management of the downstream module according to the arguments set in the stream write function. The upstream module repeats execution of the stream write function, while keeping the status ST to 'continuance' until completion of writing all the data. On completion of writing all the data, the status ST is changed to 'termination'. The upstream module then terminates the call of the stream write function for the downstream module.

There is also data transfer by the stream read function between the member module M-H and the terminator module T-A (step S430). After the data transfer, the printing process is terminated. In the standard printing process (A), the data processing flow in the printer 20 starts reception of dot data generated by the printer driver in the computer PC connected to the USB connector 91. The initiator module I-A receives the dot data via the USB connector 91. The member module M-E makes correction required in the printer 20, and the member module M-H rearranges the dot data according to the nozzle arrays on the print heads 61 through 66. The terminator module T-A transfers the rearranged data to the hardware control modules HAL, which drive the print heads 61 through 66 via the drive buffer 256 and the output distributor 259, scan the carriage 50 by means of the stepping module 23, and convey the printing paper P by means of the paper feed motor 40.

In the direct printing process (B) from the digital still camera DSC or in the card printing process (C) to print image data stored in the memory card MC, the initiator module I-B works to directly receive the image data, for example, in the JPEG format. The downstream member modules use the resizing unit 261, the binarization unit 263, and the arrangement unit 265 provided as the hardware units to process the received image data. The member modules do not directly transfer data but only transmit the timings of data transfer. The data processed by the respective hardware units are transferred via the data bus provided as the hardware component.

In the nozzle check printing process (D-1) or in the bidirectional check printing process (D-2) for the maintenance of the printer 20, a preset dot pattern is printed on the printing paper P. The initiator module I-C stores dot pattern data therein. The initiator module I-C stores two dot patterns and transfers one of the dot patterns specified by a call of a harness to the downstream member modules, which successively process the received dot pattern. The print heads 61 through 66, the stepping motor 23, and the paper feed motor 40 are driven to print the specified dot pattern for the check on the printing paper P with the scan of the carriage 50 (main scan).

As described above, the printer 20 of the embodiment provides multiple modules arranged in various combinations to execute multiple different printing processes. In response to specification of a selected printing process, the printer 20 refers to the table to arrange a combination of required modules and executes the specified printing process through required data transmission. Each module is not required to be informed of the details of the data writing process and the data reading process executed by the other modules to be combined with. Each module is only required to pass the pointer of the stream read function or the stream write function and the identification of the function executed by the module as the arguments of the G-READY function, in response to a call from the data processing path controller DPC. This arrangement desirably assures self-oriented design of the respective modules. Such independent module design is especially effective in the recent large-scale software development of printers.

Figure 15:
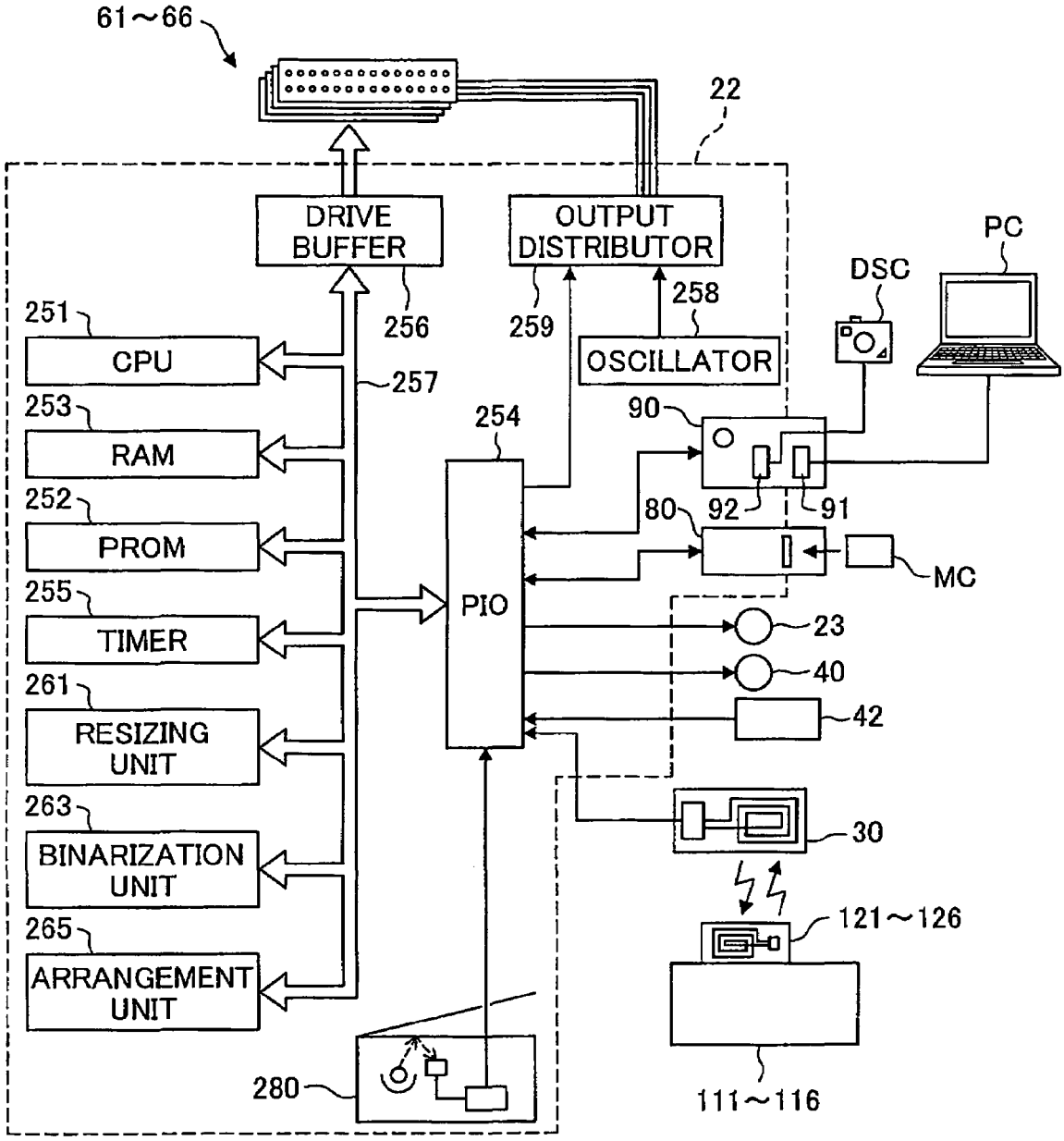
FIG. 15 is a block diagram showing the internal structure of a printer with a scanner 280 as an additional hardware component.

Another advantage of the module-based design is no requirement for any special consideration about the consistency with the operations of the existing modules in the case of addition of a new hardware component (for example, a scanner 280) to the printer 20 for an additional printing process, as shown in FIG. 15. In the example of FIG. 15, addition of the scanner 280 to the printer 20 gives additional functionality of a copy printing process (F) that actuates the print heads 61 through 66 to directly print an image read by the scanner 280 on the printing paper P. The system designer is required to simply add the functionality of the scanner 280 as a new service to the service SV, a new function FC utilizing the functionality of the scanner 280, a new harness for a call of the copy printing process, and a new combination of modules (one or multiple new modules when necessary) to execute the copy printing process. Only the arrangement of modules for the copy printing process is to be considered in the case of such addition, and there is no need of taking into account the conflict with the modules in other printing processes. The module-based design is thus extremely advantageous for addition of new functionalities to the printer 20. There are diverse functionalities newly addable to the printer 20 other than the copy printing process by addition of the scanner; for example, a capture printing process to print selected still images extracted from a moving picture by addition of a capture board for receiving video signals, a frame printing process to continually print multiple frames over a preset time period, an external image printing process to print images recorded in DVDs or other storage media by addition of a DVD player or another external device, and a label printing process to print labels on CDs and DVDs. Member modules required for these additional printing processes can be designed individually. This arrangement drastically shortens the time required for development of the whole system configuration, while desirably improving the reliability of the system.

The embodiment and its modified examples discussed above are to be considered in all aspects as illustrative and not restrictive. There may be many other modifications, changes, and alterations without departing from the scope or spirit of the main characteristics of the present invention. For example, the technique of the invention is applicable to any of laser printers, large-size printers, network printers that transmit data via a network, printers with duplex printing options, and printers that are equipped with multiple paper cassettes and multiple ink cartridges and use selected papers and ink cartridges for printing.

What we claimed is:

1. A printing device that drives a print head to implement printing on a medium, said printing device comprising:

processing module storing module that stores multiple processing modules including a module of providing object data to be printed, a module of processing the object data for a printing operation, and a module of controlling a hardware structure including the print head to print the processed object data;

a combination storage unit that stores a combination of plural processing modules selected among the multiple processing modules and mapped to each of multiple different printing processes executed by said printing device; and a printing process execution assembly that, in response to specification of one of the multiple different printing processes, arranges a sequence of plural processing modules corresponding to a stored combination of the plural processing modules mapped to the specified printing process, and executes the specified printing process;

a function providing intermediate module that defines a protocol for providing a function that allows a downstream module to read data from the function providing intermediate module and a protocol for providing a function that allows an upstream module to write data in the function providing intermediate module;

wherein said printing process execution assembly comprises a rearrangement unit that, when neither an upstream module nor a downstream module in the sequence of the plural processing modules arranged corresponding to the combination of the plural processing modules stored in said combination storage unit provides a function for data transmission, locates the function providing intermediate module between the upstream module and the downstream module to rearrange the sequence of the plural processing modules with the function providing intermediate module.

2. A printing device in accordance with claim 1, wherein at least one of the multiple processing modules has at least one of a protocol for providing a function that allows a downstream module to read data from the processing module and a protocol for writing data into the downstream module.

3. A printing device in accordance with either one of claims 1 and 2, wherein at least one of the multiple processing modules has at least one of a protocol for reading data provided by an upstream module and a protocol for providing a function that allows the upstream module to write data in the processing module.

4. A printing device in accordance with claim 1, wherein a processing module that is located at a most upstream position in any combination of plural processing modules is an initiator module that does not have a protocol related to an upstream module.

5. A printing device in accordance with claim 4, wherein the initiator module comprises a data storage unit that stores data for one of the multiple different printing processes.

6. A printing device in accordance with claim 1, said printing device further comprising:

a connector that is connectable with an external computer; and a communication unit that transmits print data expanded for printing to and from the external computer via the connector, wherein said combination storage unit stores a specific combination of plural processing modules mapped to a specific printing process among the multiple different printing processes, which drives the print head according to the print data received via the connector to implement printing on the medium.

7. A printing device in accordance with claim 1, said printing device further comprising:

a connector that is connectable with a peripheral device, such as an electronic still camera, a personal digital assistant, or a cell phone; and a communication unit that receives image data from the peripheral device via the connector, wherein said combination storage unit stores a specific combination of plural processing modules mapped to a specific printing process among the multiple different printing processes, which expands the image data received via the connector to print data and drives the print head according to the print data to implement printing on the medium.

8. A printing device in accordance with claim 1, said printing device further comprising:

a card slot that holds a memory card, which is inserted therein and has storage of image data; and an input unit that reads the image data stored in the memory card inserted in the card slot, wherein said combination storage unit stores a specific combination of plural processing modules mapped to a specific printing process among the multiple different printing processes, which expands the read image data to print data and drives the print head according to the print data to implement printing on the medium.

9. A printing device in accordance with claim 1, said printing device further comprising:

a wireless communication unit that receives image data from a peripheral device, such as an electronic still camera, a personal digital assistant, or a cell phone, by wireless communication, wherein said combination storage unit stores a specific combination of plural processing modules mapped to a specific printing process among the multiple different printing processes, which expands the image data received by wireless communication to print data and drives the print head according to the print data to implement printing on the medium.

10. A printing device in accordance with claim 1, wherein said combination storage unit stores a specific combination of plural processing modules mapped to a specific printing process of printing a dot pattern for position adjustment in bidirectional printing, among the multiple different printing processes.

11. A printing device in accordance with claim 1, wherein said combination storage unit stores a specific combination of plural processing modules mapped to a specific printing process of printing a dot pattern for nozzle check, among the multiple different printing processes.

12. A printing device in accordance with claim 1, said printing device further comprising:

an image reading unit that optically reads an image and converts the optically read image into image data, wherein said combination storage unit stores a specific combination of plural processing modules mapped to a specific printing process among the multiple different printing processes, which expands the converted image data to print data and drives the print head according to the print data to implement printing on the medium.

13. A printing device that drives a print head to implement printing on a medium, said printing device comprising:

processing module storing module that stores multiple processing modules including a module of providing object data to be printed, a module of processing the object data for a printing operation, and a module of controlling a hardware structure including the print head to print the processed object data;

a combination storage unit that stores a combination of plural processing modules selected among the multiple processing modules and mapped to each of multiple different printing processes executed by said printing device; and a printing process execution assembly that, in response to specification of one of the multiple different printing processes, arranges a sequence of plural processing modules corresponding to a stored combination of the plural processing modules mapped to the specified printing process, and executes the specified printing process, wherein a processing module that is located at a most downstream position in any combination of plural processing modules is a terminator module that does not have a protocol related to a downstream module, and wherein the terminator module is an interface module that controls the hardware structure of said printing device.

14. A printing device that drives a print head to implement printing on a medium, said printing device comprising:

processing module storing module that stores multiple processing modules including a module of providing object data to be printed, a module of processing the object data for a printing operation, and a module of controlling a hardware structure including the print head to print the processed object data;

a combination storage unit that stores a combination of plural processing modules selected among the multiple processing modules and mapped to each of multiple different printing processes executed by said printing device; and a printing process execution assembly that, in response to specification of one of the multiple different printing processes, arranges a sequence of plural processing modules corresponding to a stored combination of the plural processing modules mapped to the specified printing process, and executes the specified printing process, wherein said combination storage unit stores exclusive control information with each combination of plural processing modules, where the exclusive control information represents permission or prohibition of a call for each processing module in the combination, which is used and occupied by one printing process, from another printing process, said combination storage unit further storing busy information that represents whether each processing module in the combination is actually used and occupied by one printing process, said printing process execution assembly comprising:

a printing process prohibition unit that, in response to an external instruction for executing a selected printing process, refers to the busy information and the exclusive control information with regard to relevant processing modules to the externally instructed printing process stored in said combination storage unit and prohibits execution of the externally instructed printing process, when at least one of the relevant processing modules to the externally instructed printing process is not allowed to be called from another printing process in use of one printing process and is actually used and occupied by one printing process.

15. A printing device in accordance with claim 14, wherein said printing process prohibition module executes at least one of a cancellation process to cancel out the externally instructed printing process and a delay process to delay execution of the externally instructed printing process until completion of the use of at least one of the relevant processing modules.

16. A printing device in accordance with claim 14, said printing device further comprising:

a protocol intermediate module that defines a protocol for writing data into a downstream module and a protocol for reading data provided by an upstream module, wherein said printing process execution assembly comprises a rearrangement unit that, when both an upstream module and a downstream module in the sequence of the plural processing modules arranged corresponding to the combination of the plural processing modules stored in said combination storage unit provide a function for data transmission, locates the protocol intermediate module between the upstream module and the downstream module to rearrange the sequence of the plural processing modules with the protocol intermediate module.

17. A printing method that drives a print head to implement printing on a medium, said printing method comprising:

providing multiple processing modules that include a module of providing object data to be printed, a module of processing the object data for a printing operation, and a module of controlling a hardware structure including the print head to print the processed object data;

storing a combination of plural processing modules selected among the multiple processing modules and mapped to each of multiple different printing processes;

in response to specification of one of the multiple different printing processes, actually arranging a sequence of plural processing modules corresponding to a stored combination of the plural processing modules mapped to the specified printing process, and executes the specified printing process, providing a function providing intermediate module that defines a protocol for providing a function that allows a downstream module to read data from the function providing intermediate module and a protocol for providing a function that allows an upstream module to write data in the function providing intermediate module, and providing a printing process execution assembly comprising a rearrangement unit that, when neither an upstream module nor a downstream module in the sequence of the plural processing modules arranged corresponding to the combination of the plural processing modules stored in a combination storage unit provides a function for data transmission, locates the function providing intermediate module between the upstream module and the downstream module to rearrange the sequence of the plural processing modules with the function providing intermediate module.

18. A program product that is executable by an internal computer of a printing device to drive a print head of said printing device and thereby implement printing on a medium, said program product comprising:

a storage medium that stores program codes, wherein said program codes stored in the storage medium comprises:

a program code of providing multiple processing modules that include a module of providing object data to be printed, a module of processing the object data for a printing operation, and a module of controlling a hardware structure including the print head to print the processed object data;

a program code of, in response to specification of one of multiple different printing processes, referring to a data table, which stores a combination of plural processing modules selected among the multiple processing modules and mapped to each of the multiple different printing processes, and actually arranging a sequence of plural processing modules corresponding to a combination of the plural processing modules stored in the data table and mapped to the specified printing process; and a program code of transmitting object image data to be printed to the actually arranged sequence of the plural processing modules to execute the specified printing process, a program code of providing a function providing intermediate module to define a protocol for providing a function that allows a downstream module to read data from the function providing intermediate module and a protocol for providing a function that allows an upstream module to write data in the function providing intermediate module;

a program code of providing a rearrangement unit that, when neither an upstream module nor a downstream module in the sequence of the plural processing modules arranged corresponding to the combination of the plural processing modules which are stored provides a function for data transmission, locates the function providing intermediate module between the upstream module and the downstream module to rearrange the sequence of the plural processing modules with the function providing intermediate module.

* * * * *